US005475392A

United States Patent [19]

Newberg et al.

[11] Patent Number: 5,475,392

[45] Date of Patent: Dec. 12, 1995

[54] FREQUENCY TRANSLATION OF TRUE TIME DELAY SIGNALS

[75] Inventors: Irwin L. Newberg, Northridge; Andrew A. Walston; Howard S. Nussbaum, both of Los Angeles; Gregory L. Tangonan, Oxnard, all of Calif.

[73] Assignee: Hughes Aircraft Company, Los Angeles, Calif.

[21] Appl. No.: 130,085

[22] Filed: Sep. 30, 1993

[51] Int. Cl.[6] ..... H01Q 3/22

[52] U.S. Cl. ..... 342/375

[58] Field of Search ..... 342/375, 368

[56] References Cited

U.S. PATENT DOCUMENTS 3,090,928 5/1963 Welty ..... 342/375

5,367,305 11/1994 Völker et al. ..... 342/368

*Primary Examiner*—Gregory C. Issing

*Attorney, Agent, or Firm*—Leonard A. Alkov; W. K. Denson-Low

[57] ABSTRACT

An apparatus and method for frequency translation of true time delay signals in a phased array radar system is provided. A local oscillator signal is true time delayed or modulo $2\pi$ phase shifted and then mixed with a true time delay beamsteering signal from a true time delay circuit to produce a frequency translated transmit signal which is supplied to an antenna element. A receive signal received by an antenna element is mixed with a true time delayed or modulo $2\pi$ phase shifted local oscillator signal to provide a frequency translated receive signal. The frequency translated receive signal can then be passed through a true time delay circuit and other subsequent processing circuitry. The frequency translation permits higher frequency transmit and receive signals to be used with lower frequency true time delay devices.

14 Claims, 3 Drawing Sheets

FIG. 2(a)
PRIOR ART
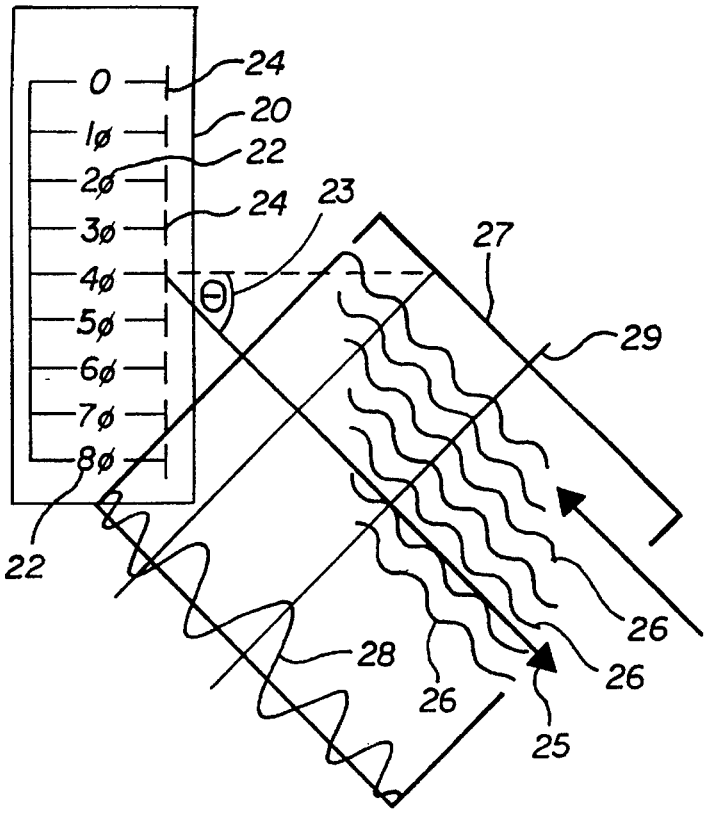
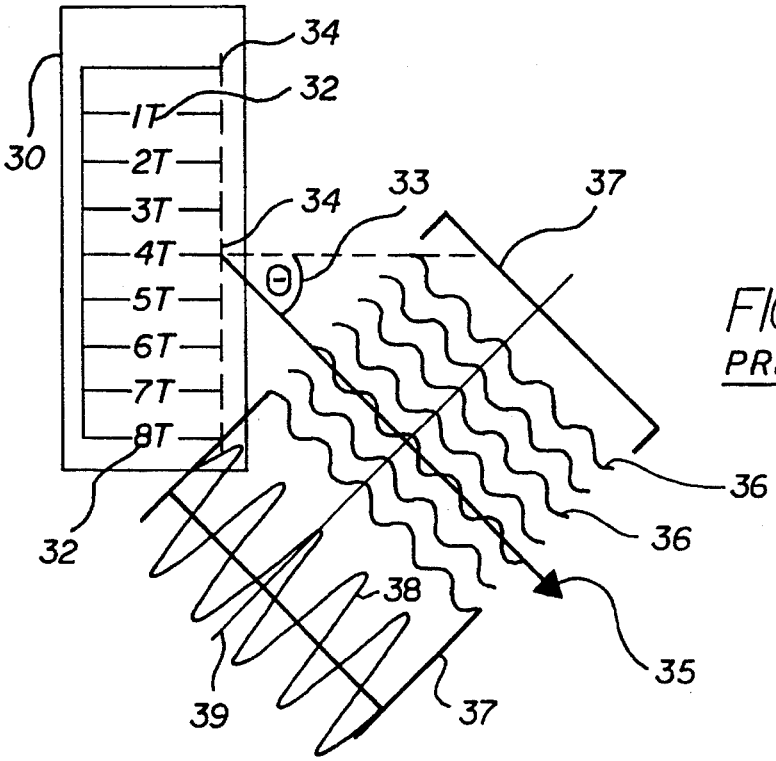
FIG. 2(b)
PRIOR ART

FREQUENCY TRANSLATION OF TRUE TIME DELAY SIGNALS

BACKGROUND OF THE INVENTION

1. Field of the Invention

The present invention relates generally to electronically beamsteered phased array radar antennas. More particularly, the present invention relates to the use of true time delay beamsteering signals in phased array radar antennas.

2. Description of Related Art

An electronically beamsteered phased array is an antenna system comprising individual fixed antenna elements in which the relative phases of the signals respectively radiated or received by the antenna elements control the effective beam pointing direction. A typical phased array antenna system 10 is shown in FIG. 1. The antenna 10 includes a number of phase shifters 12. Each phase shifter 12 provides signals to and receives signals from its corresponding antenna element 14. A pointing angle 15 is established by imparting an appropriate phase shift to the transmit and receive signals in each phase shifter 12. An RF wavefront 18 represents a line along which signals transmitted from each of the antenna elements 14 will line up in phase. A beam pointing direction 16 is perpendicular to the RF wavefront 18. The beam pointing direction 16 and RF wavefront 18 define a beam pointing angle 15 relative to the plane 19 of the antenna elements 14. An effective beam pointing angle is established for receive signals by applying an appropriate phase shift to the signals as they are received by elements 14. The beamsteering effect on both transmit and receive is substantially the same as that produced by physical repositioning of the antenna elements in a mechanically scanned antenna.

The operation of a prior art phased array antenna utilizing conventional phase shifters can be understood by reference to FIG. 2(*a*). The exemplary antenna system 20 includes a number of phase shifters 22 imparting appropriate phase shift to the signals transmitted by or received from their corresponding antenna elements 24. The different phase shift applied by each phase shifter 22 provides a beam pointing direction 25 at a desired beam pointing angle 23 as previously discussed. A portion of an exemplary radar signal is also shown in FIG. 2(*a*). The radar signal includes a pulse modulation envelope 27 superimposed on a composite RF carrier signal 28. The different phase shift imparted to signals from each phase shifter 22 results in a number of distinct phase shifted carrier signals 26. For purposes of clarity only the portion of each carrier signal 26 which falls within the time duration of a single exemplary modulation pulse is shown. The various phase shifted versions of the carrier signals 26 combine to produce the composite carrier signal 28. Line 29 is perpendicular to the beam pointing direction 25 and defines an exemplary RF wavefront. Along the wavefront all of the various phase shifted versions of the RF carrier signal 26 are aligned in phase and combine to produce the peak of the signal 28. However, since each phase shifted signal 26 takes a different amount of time to arrive at line 29, the composite carrier signal 28 is spread out in time and the carrier signal energy is not concentrated within the time duration of the pulse as desired. The pulse modulation envelope 27 therefore has a greater time duration than the pulse itself.

Present phase shifting techniques are capable of precisely establishing a particular beam pointing direction only over a relatively limited RF carrier signal frequency range. The appropriate phase shift applied in each phase shifter 12 is a function of RF carrier frequency as well as desired beam pointing angle. Frequency components of the radar signal which are higher or lower than the carrier frequency are therefore also shifted in phase by the same fixed phase shift.

The frequency dependency of the phase shift tends to limit the instantaneous bandwidth over which phased array radars can effectively operate. The instantaneous bandwidth is usually defined as the frequency range occupied by a particular signal at a given instant in time. For example, a narrow pulse of 1 ns is considered to have an instantaneous bandwidth of about 1 GHz. Instantaneous bandwidth should be distinguished from tuning bandwidth, which is typically defined as the total frequency range over which a system can be tuned or operated. The instantaneous bandwidth in a phased array antenna system using conventional phase shifters is limited because a fixed phase shift at a particular carrier frequency and beam pointing angle results in an excessive total phase shift at higher frequencies, and an insufficient total phase shift at lower frequencies. The greater the deviation in frequency from the carrier frequency, the greater the deviation in beam pointing direction. The transmitted and received signals are spread and thereby distorted by deviation in beam pointing direction. Currently available phase shifting techniques therefore significantly limit the instantaneous bandwidth over which these phased array radars can operate.

True time delay beamsteering has been used to alleviate the limited instantaneous bandwidth problem associated with conventional phase shifters. Delaying the arrival of the radar signal at the antenna has an effect similar to that of phase shifting, and serves to establish a beam pointing direction. In true time delay beamsteering, however, the conventional phase shifter discussed above is replaced with a true time delay device which can provide both phase and time delay. The true time delay device may incorporate a number of switchable fiber optic delay lines or other fiber optic components. A fiber optic cable of the appropriate length is typically switched into the transmit or receive signal path to generate the required time delay between signals corresponding to each of the antenna radiating elements. U.S. Pat. No. 5,051,754, assigned to the present assignee, discloses a true time delay phased array utilizing a photonic true time delay circuit for both the transmit and receive signal paths. The contents of U.S. Pat. No. 5,051,754 are incorporated herein by reference.

The effect of using a true time delay device to provide proper phase and time delay is shown in FIG. 2(*b*). An exemplary antenna system 30 includes a number of true time delay devices 32 which send and receive signals from their corresponding antenna elements 34. The true time delay devices provide appropriate time and phase delay to establish a beam pointing direction 35 at a desired beam pointing angle 33. Beam pointing direction 35 is perpendicular to an exemplary RF wavefront defined by line 39. Since the proper time delay has been applied to the individual carrier signals 36 from each of the antenna elements 34, each of the signals 36 line up in time within an exemplary modulation envelope 37. The time duration of modulation envelope 37 is therefore the same as the time duration of the pulse applied to each carrier signal 36. The signals 36 combine to form a composite carrier signal 38 which has a constant amplitude. The composite carrier signal energy is concentrated within the modulation envelope 37. The ideal amount of time delay can be determined independent of frequency to thus avoid the signal spreading problems associated with conventional phase shifters.

In a true time delay beamsteered phase array such as that shown in FIG. 2(*b*) the signal 36 transmitted or received by each of the n antenna elements 34 is typically delayed by a time (n–1)T in order for the signal wavefronts to line up in a particular beam pointing direction θ. This will result in the transmitted or received signals forming a coplanar wave in the desired beam pointing direction. The time delay T is determined for each of the true time delay devices in accordance with the following equation.

$$T=\frac{(m-n)d\sin\theta}{v} \qquad \text{Equation 1.}$$

Calculation of true time delay.

In the above equation, m is the total number of antenna elements, d is the distance between adjacent elements, and v is the velocity of light. The time delay T is therefore independent of frequency. A true time delay beamsteered phased array is preferably capable of providing these time delays for both transmit and receive signals.

In a true time delay beamsteered system, the appropriate time delay as defined by the above equation is provided to the transmit and receive signals using fiber optics or other delay techniques. A similar fiber optic array, or the like, is used to generate the time delays for each of the antenna elements in order to establish a coplanar wavefront in a desired beam pointing direction. The bandwidth of the true time delay signal is therefore limited to the bandwidth of the delay line or other components utilized in the true time delay beamsteering device.

The full advantages of true time delay are thus not obtained under current practice. Most fiber optic components currently available can operate adequately up to a frequency of approximately 5 GHz. Although certain fiber optic components operating at frequencies up to 10 GHz are commercially available, at higher frequencies performance generally degrades or the cost to achieve good performance goes up significantly. At frequencies of about 18 GHz or higher, currently available fiber optic components typically have poor performance and therefore are not generally considered suitable for steering a phased array antenna.

SUMMARY OF THE INVENTION

It is a primary object of the invention to solve the above-identified problems as well as other problems in the prior art.

It is a further object of the present invention to provide a method and apparatus whereby a local oscillator signal is mixed with a true time delay signal, resulting in a beamsteered radar signal which will remain correctly pointed at the desired beam pointing angle independent of the carrier signal frequency transmitted or received.

It is a further object of the present invention to enable a fiber optic true time delay phased array beamsteering device operating at one frequency to generate true time delay beamsteering signals for a phased array antenna that transmits or radiates at another frequency.

These, as well as other additional objects of the invention are accomplished by delaying a local oscillator signal and mixing it with a true time delay beam steering signal to produce a radar signal which transmits at a higher frequency than the fiber optic beamsteering signal, while maintaining the desired beam pointing direction of the phased array antenna. The process is reversed for signals received by the phased array antenna. Received signals are mixed to a lower frequency by a delayed local oscillator signal and then passed through the true time delay device.

These and other objects, advantages and features of the present invention will become readily apparent to those skilled in the art from a study of the following Description of Preferred Embodiments when read in conjunction with the attached drawings and appended claims.

BRIEF DESCRIPTION OF THE DRAWINGS

FIG. 2 illustrates the distinction between phase shifting and true time delay for an exemplary radar signal. FIG. 2(*a*) shows a conventional phase shifted radar signal while FIG. 2(*b*) shows a true time delayed radar signal.

DESCRIPTION OF PREFERRED EMBODIMENTS

Figure 1:
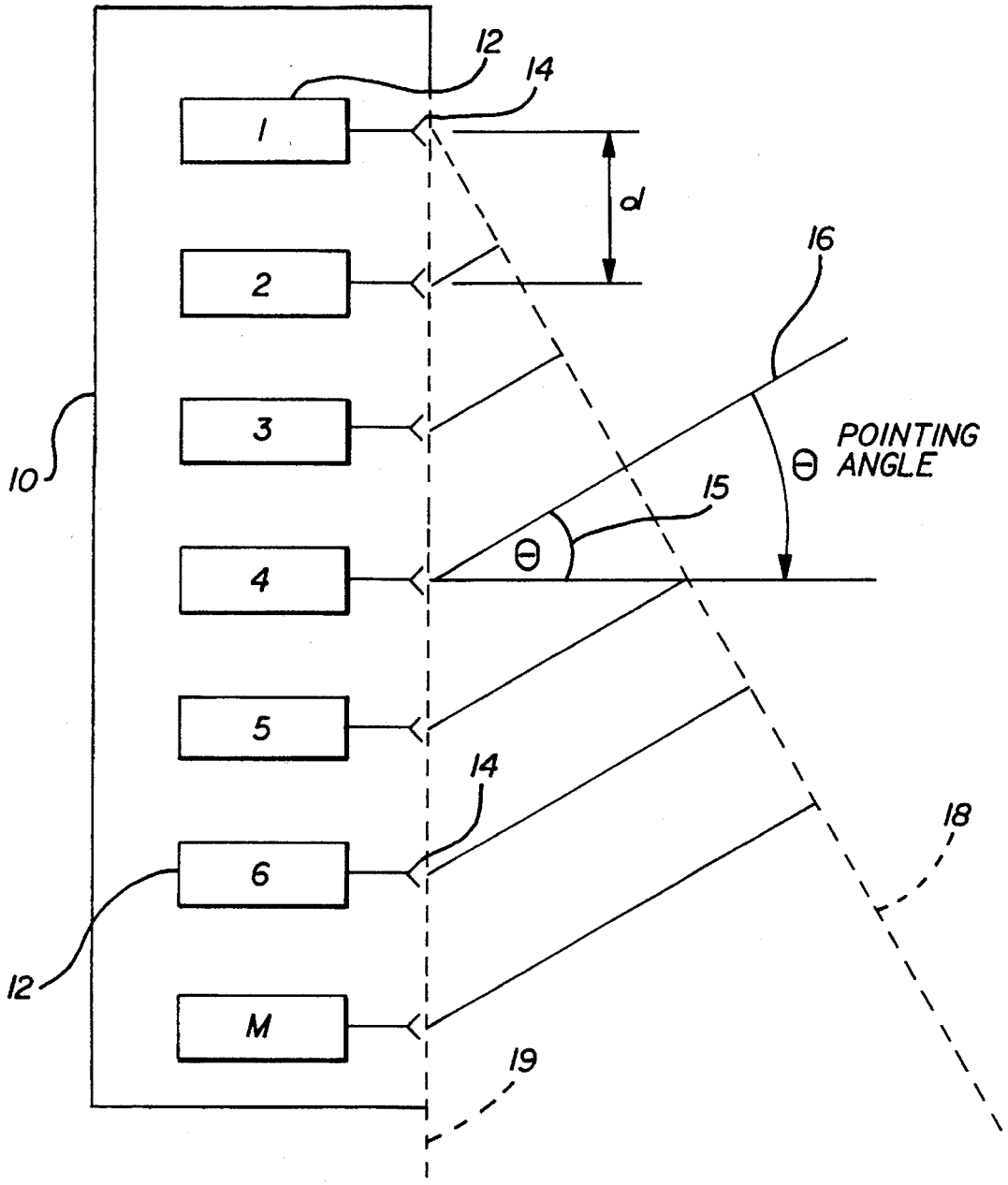
FIG. 1 PRIOR ART
FIG. 1 shows a prior art phased array antenna capable of establishing a beam pointing direction at an angle to the direction of orientation of the antenna array.

The present invention permits use of a fiber optic or other type of true time delay beamsteering device in a phased array radar system when the true time delay is developed at a frequency other than the antenna radiating frequency. The present invention allows a true time delay signal to be developed at one frequency and then translated or mixed to another frequency using a mixer and a local oscillator signal. The frequency at which the true time delay signal is developed is usually lower than the frequency to which it is subsequently translated. When a true time delay signal is mixed to translate it to another frequency, the resulting signal will have the correct time delay but will not have the correct relative phase value for true time delay beamsteering at the resulting signal frequency. It should be understood that the terms "mixer" and "mixing" as used herein refer to any device which is capable of receiving at least two input signals and providing an output signal at a frequency which is the sum, difference or higher order sum or difference product of the two input signal frequencies or any harmonics thereof.

As discussed above, the primary purpose of using true time delay beamsteering is to have the antenna beam pointed correctly in a desired beam pointing direction independent of frequency. This is accomplished by delaying the signal by the correct value at each of the radiating elements of the phased array. The delay will typically only produce the correct relative phase for frequency independent beamsteering when the delay is implemented at the antenna radiating frequency. This is because modulo 2π phase is typically used to steer the antenna and the time delay assures the signals arrive at the same time. Modulo 2π phase is defined as the fractional value of total delay between 0° and 360°. When true time delay steering is used at the radiated signal frequency, the modulo 2π relative phase at each radiating element will steer the array correctly independent of frequency because the relative phases will change proportionally so as to maintain the correct relative phases. If a true time delayed signal is mixed to another frequency, the relative modulo 2π phase of the mixer output signal will be a function of the frequencies and phases of the mixer input signals and this will typically not be the correct relative modulo 2π phase to steer an antenna independent of frequency. Thus, the use of mixing alone will cause the antenna beam pointing direction to change as a function of the mixer input frequency. The present invention overcomes this problem by using an appropriately delayed local oscillator signal in the mixing process.

Several mathematical equations will clarify the operation of a mixer used in frequency translation of a true time delay beamsteering signal. The following equations describe the performance of a mixer in terms of the output signal produced in response to various input signals. Re indicates the real part of a complex mixer input or output signal, $\omega_1$ is the mixer input signal frequency representing a true time delay beamsteering signal, $\omega_2$ is a local oscillator signal frequency, $(\omega_1 \pm \omega_2)$ indicates the mixer output frequencies which include the sum $(\omega_1+\omega_2)$ and difference $(\omega_1-\omega_2)$ frequencies, t represents time, A is the amplitude of the true time delay signal, and B is the amplitude of the local oscillator signal. The symbol $\otimes$ indicates mixing. T represents the true time delay determined in accordance with Equation 1 above and applied to the input true time delay beamsteering signal. In all of the following equations, only the sum frequencies are shown. It should be understood that the mixing processes discussed will also generate similarly affected difference products.

$$Re(Ae^{j\omega_1 t} \otimes Re(Be^{j\omega_2 t}) = Re(ABe^{j(\omega_1+\omega_2)t})$$

Equation 2. Basic mixer equation.

$$Re(Ae^{j\omega_1(t-T)} \otimes Re(Be^{j\omega_2 t}) = Re(ABe^{j[(\omega_1+\omega_2)t-\omega_1 T]})$$

Equation 3. Mixer equation for true time delayed input.

$$Re(Ae^{j\omega_1(t-T)} \otimes Re(Be^{j\omega_2(t-T)}) = Re(ABe^{j[(\omega_1+\omega_2)(t-T)]})$$

Equation 4. Mixer equation for true time delayed input and time delayed local oscillator signal.

A basic mixing operation with no time delay is shown in Equation 2 above. The effect of applying a true time delay T to the mixer input signal only is shown in Equation 3. The mixer output shown includes a term that has time delay T affecting only the mixer input signal frequency term rather than the sum frequency term which represents the desired transmit frequency. The sum frequency mixer output term is supplied to the antenna radiating elements for transmission. The transmit signal thus includes a term that has a phase which is a function of the product of delay T and mixer input signal frequency $\omega_1$ only. The phased array antenna steering will therefore not be independent of frequency. Equation 3 clearly illustrates that it is not possible to obtain the benefits of true time delay at higher transmit signal frequencies by simply mixing a lower frequency true time delay signal to a higher transmit signal frequency.

One way in which the present invention solves the frequency dependency problem shown in Equation 3 above is by introducing an appropriate true time delay into the local oscillator signal supplied to the mixer. Equation 4 describes the output frequency of a mixer with a true time delay T applied to both the mixer input frequency and the local oscillator signal. The output signal phase is now only a function of the product of the sum frequency and the true time delay, and the antenna beam pointing will therefore be correct regardless of the transmit signal frequency. A true time delay on both the mixer input signal and the local oscillator signal thus produces a mixer output signal that has an appropriate true time delay. The output signal true time delay generated via the mixing process shown in Equation 4 has the same effect as if the true time delay had been directly applied to the output signal at the transmit frequency.

An alternative means for accomplishing the above described frequency translation of a true time delay signal is to use a modulo $2\pi$ phase shifter instead of a true time delay for the local oscillator signal. A modulo $2\pi$ phase shifter can be used because the local oscillator is a CW signal at a fixed frequency. A true time delay applied to a CW signal in effect only changes the modulo $2\pi$ phase of the CW signal since the CW signal repeats itself every $2\pi$ or 360°. It is therefore possible to set a phase value between 0° and 360° for the local oscillator signal which will produce the same effect as that produced using an actual true time delay.

The appropriate phase shift is that required to develop at the local oscillator signal frequency the effective equivalent of the true time delay applied to the mixer input signal. The value of phase shift is determined by calculating the modulo $2\pi$ phase value that a true time delay of length T would have at the local oscillator signal frequency. The true time delay T is the delay established at the mixer input signal frequency to provide a desired beam pointing direction. The phase shift applied to the local oscillator for a given beam pointing direction is therefore the same regardless of the mixer input signal frequency. Steering the antenna to a different pointing direction will require calculation of a new value of true time delay T in accordance with Equation 1 above. The local oscillator phase shift would then also be re-calculated in accordance with the new time delay value. The sum of the phase shift in the local oscillator path and the mixer input signal true time delay is equivalent to the delay required to provide true time delay at the transmit frequency.

The local oscillator phase shifter is simple to construct because the local oscillator is a CW signal. In a typical phased array radar system, the mixer input signal will vary over a wide range of frequencies. These input signal frequencies will be compatible with the limited operating frequency range of fiber optic delay lines or other delay circuitry. The phase shifter in the local oscillator signal path will typically be a relatively high frequency phase shifter but will have a very narrow tuning bandwidth in view of the fact that the local oscillator is a CW signal.

Mixing a true time delay signal with a local oscillator signal in accordance with the present invention allows the phased array radar system to transmit and receive radar signals with frequencies increased by the frequency of the local oscillator signal. For example, a CW local oscillator frequency of 60 GHz can be mixed with a lower frequency true time delay beam steering signal. A phased array system using a fiber optic true time delay device with a bandwidth of about 5 GHz would be limited to transmit frequencies within this bandwidth absent the mixing with the local oscillator signal. By mixing the true time delay signal with the higher frequency local oscillator the radar system can then transmit signals between 60 GHz and 65 GHz. If the bandwidth of the fiber optic true time delay signal is 10 GHz, then the transmit signal could be between 60 GHz and 70 GHz. Appropriate filtering may be included at the mixer output to eliminate undesirable higher order mixing products or signal leakage in a manner well known in the art.

In a phased array radar system the sum frequency mixer output will typically be used to frequency translate transmit signals, while the difference frequency mixer output will typically be used to frequency translate receive signals. It should be understood that this is by way of example and not limitation. Frequency translation on either transmit or receive could be performed using either the sum or the difference signal from the mixer.

It should be noted that, in accordance with the present invention, when the difference signal is used for beamsteering after frequency translation, the mixing process described above may produce an incorrect relative phase shift as a result of the negative sign in the difference signal. The conjugate of the calculated local oscillator phase shift should therefore be used to provide the equivalent delay of the local oscillator whenever a difference signal is used to frequency translate a true time delay signal. As mentioned previously, this will typically be the case for translating high frequency received signals to lower frequencies. If a signal is expressed as a complex number with a magnitude and phase angle, the conjugate phase is simply the negative of that phase angle. When the sum signal is used, it is not necessary to take the conjugate of the phase.

If a true time delay device is used instead of an equivalent phase shift to delay the local oscillator signal, the conjugate of the local oscillator signal phase can be provided by switching the delay setting of a fiber optic true time delay circuit when difference signals are being used. For example, in a fiber optic true time delay circuit in which y of x available discrete delays are used to steer a sum signal at a particular phase, the conjugate phase may be produced for the difference signal by using x-y delays. This automatically gives you the correct conjugate phase. In a case in which sum signals are used for frequency translation on transmit and difference signals on receive, separate true time delay circuits could be used in the transmit and receive signal paths. The receive signal path true time delay circuit would then be suitably modified to provide the conjugate phase of the difference signal as described above. Alternatively, the same true time delay circuit can be used for both transmit and receive by changing the delay values as described above. There is usually no sign reversal problem for the true time delay introduced in the modulation envelope in the transmit signal path since the sum signal is typically used.

Figure 3:
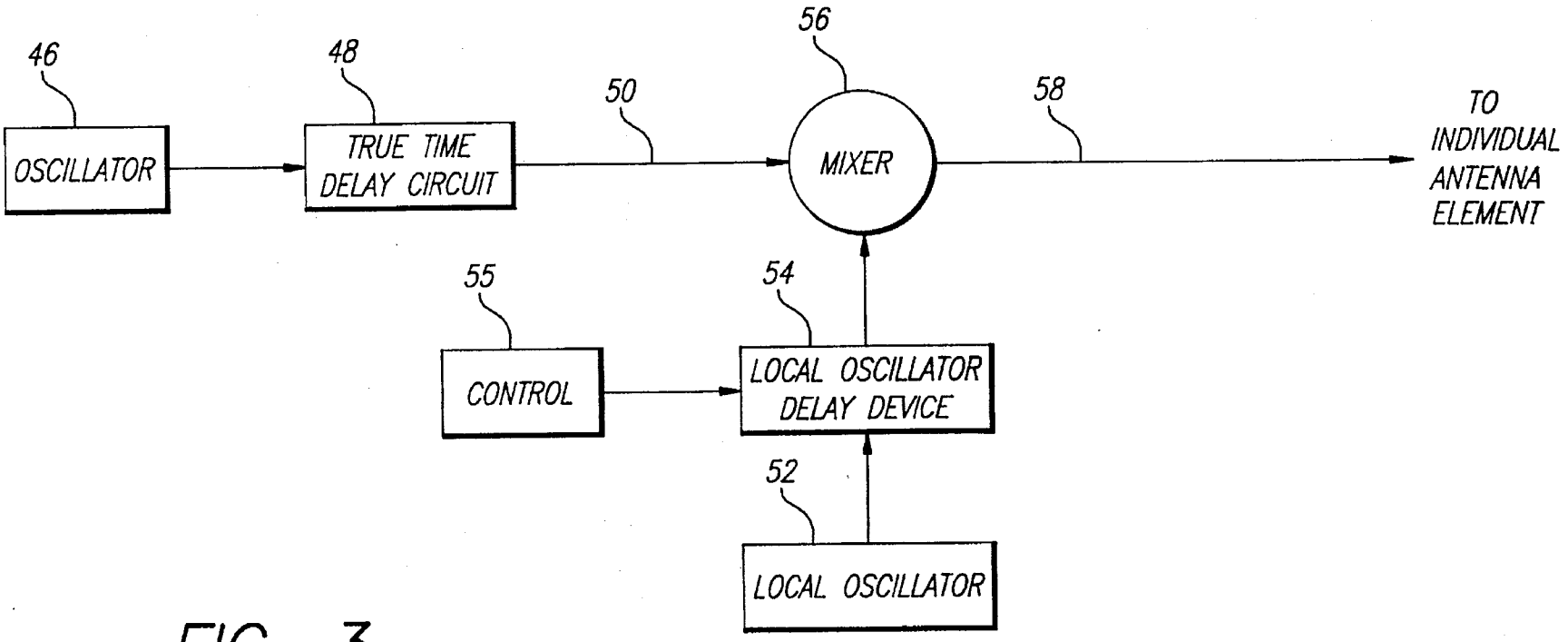
FIG. 3 shows a preferred embodiment of an exemplary phased array transmit signal path in accordance with the present invention.

FIG. 3 illustrates a preferred embodiment of an exemplary transmit signal path in accordance with the above description of the present invention. The exemplary circuitry shown is representative of a single transmit signal path in a phased array radar system. A similar transmit signal path may be provided for each of the antenna elements. It should also be understood that the present invention can also be readily applied to a receive signal path as will be discussed in greater detail below. In the exemplary embodiment of FIG. 3 a first oscillator 46 generates a first signal. The first signal is passed through a fiber optic true time delay circuit 48 to create a true time delay beamsteering signal 50. The true time delay beamsteering signal 50 is supplied as a mixer input signal to mixer 56 where it is mixed with the output of a local oscillator 52.

Local oscillator 52 preferably generates a signal having a higher frequency than the signal generated by the first oscillator 46. The local oscillator signal is generally produced as a CW signal. The phase of the local oscillator signal is shifted by a local oscillator delay device 54. The local oscillator delay device may be a narrowband phase shifter, a true time delay circuit or other suitable true time delay device. As mentioned previously, the value of phase shift applied is determined by calculating the modulo $2\pi$ phase value that a true time delay of length T would have at the local oscillator signal frequency. The sum of the phase shifted local oscillator signal phase and the true time delay beamsteering signal phase are therefore equivalent to the phase that would be present if the true time delay beamsteering signal was operating at the transmit signal frequency.

The effect of using an appropriately phase shifted local oscillator is the same as that produced by using appropriate true time delay circuits to delay both the local oscillator signal and the mixer input signal. It would therefore be possible to use a true time delay circuit for local oscillator delay device 54. It may be difficult, however, to construct a fiber optic true time delay circuit at the higher local oscillator signal frequency. The use of a local oscillator phase shifter provides the same effect because the local oscillator is a single frequency CW signal as discussed in greater detail above. Conventional phase shifters, such as solid state diodes or ferrite devices, may be used to shift the local oscillator signal phase as will be appreciated by those knowledgeable and skilled in the art. Since the local oscillator signal is a periodic signal which repeats itself every $2\pi$, the total required delay can may be applied as a phase shift equal to the total delay modulo $2\pi$.

The true time delay signal and the phase shifted local oscillator signal are translated in frequency by mixer 56 to provide an output 58 which is a high frequency true time delayed radar transmit signal. As mentioned above, it may be necessary to include appropriate filtering at the mixer output to eliminate undesirable mixing products or signal leakage from either the local oscillator or the mixer input signal. The need for filters will depend upon the signal frequencies used, as well as the characteristics of the mixer and the transmit and receive signal performance requirements. The filters appropriate in a given application may be provided using techniques well known in the art and therefore will not be further discussed herein.

The output 58 of the mixer 56 is transmitted by one of the phased array antenna elements. For a transmit signal the sum frequency product of mixer 56 is typically used in order to provide higher frequency transmit capabilities. The difference frequency product and the conjugate modulo $2\pi$ of the phase term is typically used on receive as discussed above. When the sum frequency is used on transmit, the transmit signal has a frequency greater than that of the true time delay mixer input signal 50. Control of the pointing direction of a phased array antenna is thus accomplished using a beamsteering signal which is of a lower frequency than the frequency of transmission without limiting the frequency independence of the actual transmit and receive signals.

As was previously mentioned, the present invention can also be applied to signals received by the phased array antenna elements. Each receive signal is mixed down to a lower frequency using a local oscillator and a mixer similar to that described above in conjunction with transmit signals. The lower frequency signal is a frequency translated version of the receive signal which typically represents the difference product of the local oscillator signal and the received signal. The local oscillator is true time delayed or phase shifted by an amount appropriate for a particular antenna element to establish a desired beam pointing direction for the phased array. The frequency translated receive signal can then be passed through a true time delay device to provide the appropriate true time delay for the difference signal. The frequency translated and true time delayed version of the receive signal can then be supplied to subsequent circuitry for analog-to-digital conversion or other processing. Again it should be noted that using the difference signal will require using the conjugate modulo $2\pi$ of the appropriate local oscillator phase shift determined in accordance with the above description of the exemplary transmit signal path.

A separate receive mixer will preferably be used to perform the frequency translation function for each of the received signals. Alternatively, additional switching circuitry could be provided such that the transmit and receive signals are applied to the appropriate inputs of a single mixer used for both transmit and receive through a particular antenna element. The switching circuitry could configure the mixer such that the high frequency transmit output signal and the high frequency receive input signal are connected to the appropriate mixer port during respective transmit and receive periods of antenna operation.

A separate mixer will preferably be supplied for each of the antenna elements in order to properly steer the antenna beam in accordance with the present invention. The mixers should be located in relatively close proximity to the antenna elements to minimize high frequency signal losses on both transmit and receive. The true time delay circuits used for the mixer input signals could be remoted away from the mixers and antenna elements. Since the local oscillator signals and their corresponding phase shifters will typically operate at relatively high frequencies, it is preferable that they be located near the mixers and therefore near the antenna elements.

The present invention avoids limiting true time delay radar signal frequencies to those frequencies which can be transferred through a delay line or other true time delay device by mixing the true time delay signal with a higher frequency delayed signal. The present invention thus enables transmit and receive radar operation at frequencies higher than the highest available true time delay circuit operating frequency. True time delay is maintained by true time delaying or modulo $2\pi$ phase shifting a CW local oscillator signal before mixing it with the true time delay beamsteering signal. Local oscillator delay device 54 provides the appropriate phase delay to the local oscillator signal. The phase of the local oscillator signal can be shifted in response to signals supplied by control circuitry 55 as appropriate for establishing a desired beam pointing angle.

Although the foregoing description is directed to an exemplary true time delay signal frequency translation apparatus and method, it is recognized that deviations in the mixer operation, true time delay and other parameters may also be made. For example, the frequency translation of the present invention could make use of higher order sum and difference products available at the mixer output. The present invention can be tailored to the requirements of particular phased array designs by including appropriate filtering at the mixer output as is well known in the art. Any desired number of signals may be frequency translated in a similar manner as required for a given phased array design. The same local oscillators and phase shifters could be used for both transmit and receive signal paths. A single local oscillator could supply signals to several antenna elements or each antenna element could be supplied with its own local oscillator. Furthermore, the present invention is not limited to use with a particular type of true time delay device. Other delay line devices with different operating frequencies may be used, including waveguide, standing waves and electronically generated delays. Those skilled in the art may now make numerous uses of and departures from the above described embodiments without departing from the inventive concepts which are defined by the following claims.

What is claimed is:

1. A method for controlling the beam pointing direction of phased array radars comprising the steps of:

generating a first signal of a first signal frequency true time delaying said first signal by applying a true time delay T thereto;

generating a local oscillator signal of a local oscillator frequency $\omega_2$;

delaying said local oscillator signal by a predetermined amount to provide a delayed local oscillator signal, including true time delaying said local oscillator signal by an amount equivalent to said true time delay applied to said first signal;

mixing said true time delayed first signal and said delayed local oscillator signal such that a sum of said first signal and said delayed local oscillator signal forms a transmit signal with a phase which is only a function of $(\omega_1+\omega_2)$; and sending said transmit signal to an antenna element for transmission.

2. The method of claim 1 further including the steps of:

receiving a receive signal from said antenna element; and mixing said receive signal and said delayed local oscillator signal such that a difference of said received signal and said delayed local oscillator signal forms a frequency translated received signal.

3. The method of claim 2 in which said step of mixing said receive signal with said delayed local oscillator signal further includes using a delayed local oscillator signal having a phase which is a conjugate of a phase of said delayed local oscillator signal used in said step of mixing said true time delayed first signal and said delayed local oscillator signal to form said transmit signal.

4. A method for controlling the beam pointing direction of phased array radars comprising the steps of:

generating a first signal of a first signal frequency true time delaying said first signal by applying a true time delay T thereto;

generating a local oscillator signal of a local oscillator frequency $\omega_2$;

delaying said local oscillator signal by a predetermined amount to provide a delayed local oscillator signal, including modulo $2\pi$ phase shifting said local oscillator signal by a phase shift equivalent to the modulo $2\pi$ value of said true time delay applied to said first signal;

mixing said true time delayed first signal and said delayed local oscillator signal such that a sum of said first signal and said delayed local oscillator signal forms a transmit signal with a phase which is only a function of $(\omega_1+\omega_2)$; and sending said transmit signal to an antenna element for transmission.

5. The method of claim 5 further including the steps of:

receiving a receive signal from said antenna element; and mixing said receive signal and said delayed local oscillator signal such that a difference of said receive signal and said delayed local oscillator signal forms a frequency translated receive signal.

6. The method of claim 5 in which said step of mixing said receive signal with said delayed local oscillator signal further includes using a delayed local oscillator signal having a phase which is a conjugate of a phase of said delayed local oscillator signal used in said step of using said true time delayed first signal and said delayed local oscillator signal to form said transmit signal.

7. A method for steering phased array radar antenna comprising a plurality of discrete antenna elements comprising the steps of:

generating a first signal of a first signal frequency $\omega_1$;

delaying said first signal independently for each of the plurality of discrete antenna elements by applying a true time delay T thereto to form a plurality of true time delay beamsteering signals, one for each of the plurality of antenna elements, having a particular delay associated with each of the plurality of antenna elements which is determined by the direction of transmission desired;

generating a local oscillator signal of a local oscillator signal $\omega_2$;

delaying said local oscillator signal independently for each of the plurality of discrete antenna elements by an amount based on a desired direction of antenna transmission to form a plurality of delayed local oscillator signals, including true time delaying said local oscillator signal by an amount equivalent to said true time delay applied to each of said true time delay beamsteering signals.

8. The method described in claim 7 further including the steps of:

receiving a plurality of receive signals, one from said each of said plurality of antenna elements; and mixing each of said plurality of receive signals with said delayed local oscillator signals such that a difference of said receive signals and said delayed local oscillator signals forms a plurality of frequency translated receive signals.

9. The method of claim 8 in which said step of mixing said receive signals with said delayed local oscillator signals for each of said antenna elements further includes using a delayed local oscillator signal for each of said elements having a phase which is a conjugate of a phase of said delayed local oscillator signals used for each of said elements in said step of mixing said true time delay beamsteering signals and said delayed local oscillator signals to form said transmit signals.

10. The method described in claim 7 in which said transmission of said output signals remains pointed in a predetermined direction regardless of variation in a frequency of said transmit signal.

11. A method for steering phase array radar antenna comprising a plurality of discrete antenna elements comprising the steps of:

generating a first signal of a first signal frequency $\omega_1$;

delaying said first signal independently for each of the plurality of discrete antenna elements by applying a true time delay T thereto to form a plurality of true time delay beamsteering signals, one for each of the plurality of antenna elements, having a particular delay associated with each of the plurality of antenna elements which is determined by the direction of transmission desired;

generating a local oscillator signal of a local oscillator signal $\omega_2$;

delaying said local oscillator signal independently for each of the plurality of discrete antenna elements by am amount based on a desired direction of antenna transmission to form a plurality of delayed local oscillator signals, including modulo $2\pi$ phase shifting said local oscillator signal by a phase shift equivalent to the modulo $2\pi$ value of said true time delay applied to each of said true time delay beamsteering signals;

mixing said plurality of true time delay beamsteering signals with said plurality of delayed local oscillator signals for each of said plurality of antenna elements such that a sum of said true time delay beamsteering signals and said delayed local oscillator signals form a plurality of transmit signals with phases which are only a function of $\omega_1 + \omega_2$), one for each of said plurality of antenna elements; and sending each of said plurality of transmit signals to an associated antenna element for transmission.

12. The method described in claim 11 further including the steps of:

receiving a plurality of receive signals, one from said each of said plurality of antenna elements; and mixing each of said plurality of receive signals with said delayed local oscillator signals such that a difference of said receive signals and said delayed local oscillator signals forms a plurality of frequency translated receive signals.

13. The method of claim 12 in which said step of mixing said receive signals with said delayed local oscillator signals for each of said antenna elements further includes using a delayed local oscillator signal for each of said elements having a phase which is a conjugate of a phase of said delayed local oscillator signals used for each of said elements in said step of mixing said true time delay beamsteering signals and said delayed local oscillator signals to from said transmit signals.

14. The method described in claim 11 in which said transmission of said output signals remains pointed in a predetermined direction regardless of variation in a frequency of said transmit signal.

* * * * *